US010939728B2

(12) United States Patent
Mangold et al.

(10) Patent No.: US 10,939,728 B2
(45) Date of Patent: Mar. 9, 2021

(54) INSOLE

(71) Applicant: CMC Consumer Medical Care GmbH, Sontheim an der Brenz (DE)

(72) Inventors: Rainer Mangold, Herbrechtingen (DE); Angela Roempp, Duernau (DE); Mareike Meyer, Gronau (DE)

(73) Assignee: CMC Consumer Medical Care GmbH, Sontheim an der Brenz (DE)

( * ) Notice: Subject to any disclaimer, the term of this patent is extended or adjusted under 35 U.S.C. 154(b) by 507 days.

(21) Appl. No.: 15/758,007

(22) PCT Filed: Sep. 2, 2016

(86) PCT No.: PCT/EP2016/070744
§ 371 (c)(1),
(2) Date: Mar. 7, 2018

(87) PCT Pub. No.: WO2017/045937
PCT Pub. Date: Mar. 23, 2017

(65) Prior Publication Data

US 2018/0249786 A1 Sep. 6, 2018

(30) Foreign Application Priority Data

Sep. 17, 2015 (EP) ..... 15185713

(51) Int. Cl.
*A43B 17/00* (2006.01)
*A43B 17/18* (2006.01)
(Continued)

(52) U.S. Cl.
CPC ..... *A43B 17/006* (2013.01); *A43B 13/24* (2013.01); *A43B 13/26* (2013.01); *A43B 17/105* (2013.01); *A43B 17/18* (2013.01)

(58) Field of Classification Search
CPC ..... A43B 17/00; A43B 17/006; A43B 17/18; C09J 2301/10; C09J 2301/20; C09J 2301/204; C09J 2301/21
(Continued)

(56) References Cited

U.S. PATENT DOCUMENTS 2,510,120 A * 6/1950 Leander ..... C09J 7/21 428/191
2,865,097 A * 12/1958 Vollrath, Jr. ..... A43B 17/18 36/43
(Continued)

FOREIGN PATENT DOCUMENTS

WO 0172414 A2 10/2001
WO 2004012549 A1 2/2004
WO 2012021058 A1 2/2012

OTHER PUBLICATIONS

International Search Report and Written Opinion from PCT/EP2016/070744 dated Nov. 9, 2016.

*Primary Examiner* — Marie D Bays
(74) *Attorney, Agent, or Firm* — Dilworth & Barrese, LLP

(57) ABSTRACT

The invention relates to an insole (100) for shoes with a base material, which comprises a sole surface (102) facing the shoe and an opposite foot surface facing the foot, wherein a coating (112) is provided on the sole surface (102), which provides the sole surface (102) of the insole (100) with an increased frictional force with respect to the uncoated sole surface (102), characterised in that the coating (112) is formed from a plurality of individual patterns (120) formed from coating lines (114), which are discrete from one another and are arranged in such a way that they cannot be formed by one or more continuous coating lines (114)
(Continued)

Figure 1:
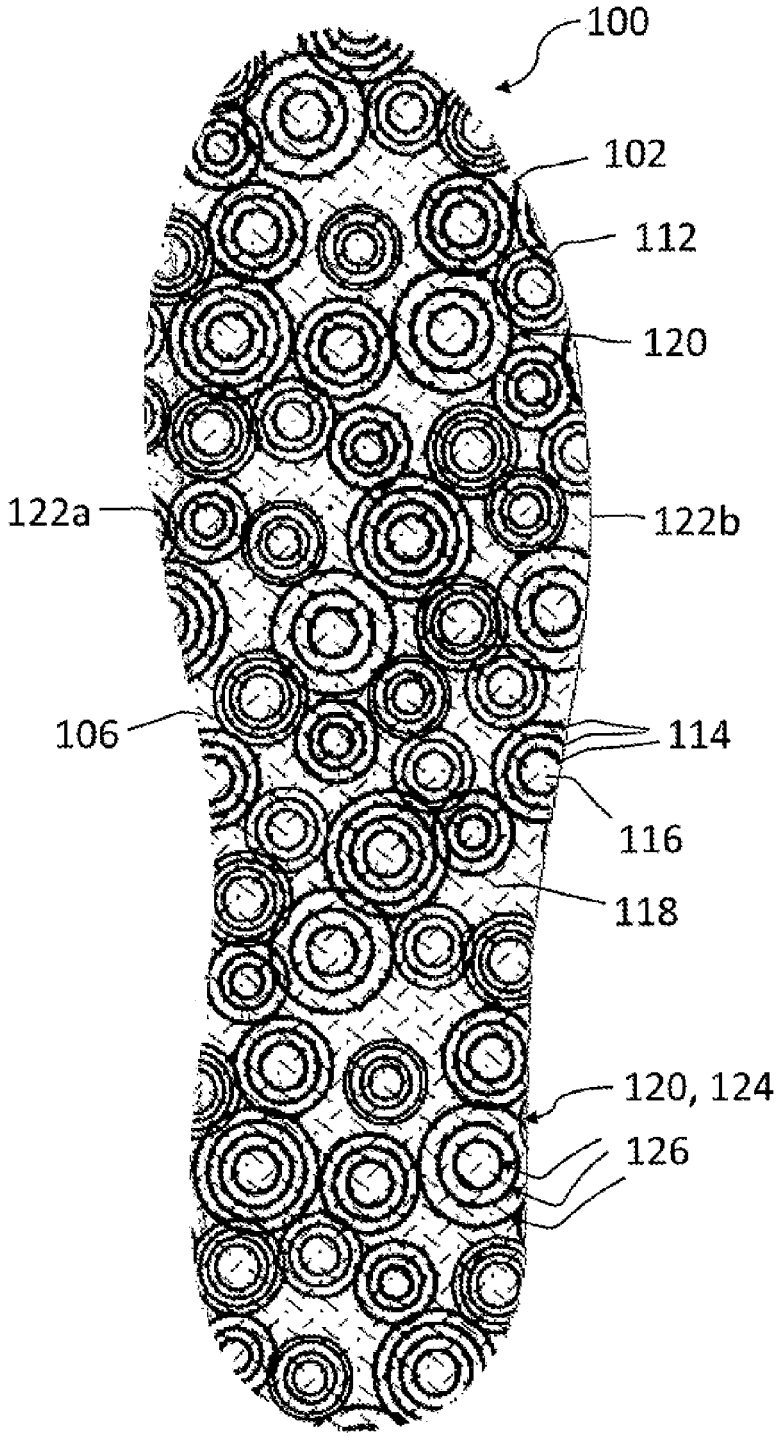

miming continuously from a first side (122*a*) of the sole surface (102) to an opposite second side (122*b*) of the sole surface (102).

22 Claims, 9 Drawing Sheets

(51) Int. Cl.
*A43B 13/26* (2006.01)
*A43B 13/24* (2006.01)
*A43B 17/10* (2006.01)

(58) Field of Classification Search
USPC ..... 36/43, 44
See application file for complete search history.

(56) References Cited

U.S. PATENT DOCUMENTS 5,686,169 A * 11/1997 Hassall ..... B32B 37/1292 428/195.1
7,047,671 B2 * 5/2006 Steed ..... A43B 13/24 36/43
8,151,487 B2 * 4/2012 McLinden ..... A43B 7/1425 36/43
8,776,398 B2 * 7/2014 McLinden ..... A43B 17/102 36/43
2002/0066209 A1 * 6/2002 Steed ..... A43B 17/003 36/44
2002/0090496 A1 * 7/2002 Kim ..... B42D 5/003 428/201
2002/0108564 A1 * 8/2002 Gruenewald ..... C09J 7/20 118/125
2002/0137420 A1 9/2002 Dacey et al.
2005/0066544 A1 * 3/2005 Beak ..... A41B 11/008 36/43
2006/0035061 A1 2/2006 Mangold et al.
2007/0271819 A1 * 11/2007 Chen ..... A41B 11/008 36/43
2011/0205326 A1 * 8/2011 Roth ..... B41J 2/32 347/171
2013/0220510 A1 * 8/2013 Yamamoto ..... B32B 37/144 156/60
2014/0109438 A1 4/2014 Hoogerbrugge et al.
2014/0186566 A1 * 7/2014 Wood ..... C09J 7/22 428/41.8
2015/0230551 A1 * 8/2015 O'Brien ..... A43B 17/105 36/44
2016/0143791 A1 * 5/2016 Wood ..... A61L 15/58 24/306
2016/0198790 A1 * 7/2016 Ishmael ..... A41D 13/06 2/239
2018/0249786 A1 * 9/2018 Mangold ..... A43B 17/105
2019/0292415 A1 * 9/2019 Sato ..... H01L 23/12
2020/0046073 A1 * 2/2020 Alterio ..... A43B 17/18

* cited by examiner

INSOLE

This application claims priority to European Patent Application No. 15185713.3 filed on Sep. 17, 2015.

The invention relates to an insole for shoes with a base material comprising a sole face facing the shoe and an opposing foot face facing the foot, a coating being applied to the sole face which provides the sole face of the insole with an increased frictional force relative to the uncoated sole face, wherein the coating consists of a plurality of coating lines.

Such a coating is known from WO 01/72 414 A2 which has, on the one hand, a high coefficient of friction and, on the other hand, low adhesion, to prevent the shoe sole from slipping but at the same enabling easy removal of the insole. Grid-shaped or striped patterns and individual island-shaped, all-over patterns on the sole face of the insole are preferred in this case.

It is moreover already known from EP 1 524 925 A1, in the case of a disposable insole, to apply very fine, mutually spaced, island-shaped nubs to the underside of the insole which is remote from the foot face and faces the inner sole of a shoe by screen printing or rotary press methods, said nubs being formed of natural or synthetic rubber, of acrylate-based aqueous dispersions or of an acrylate/latex mixture or of polyurethane or of polyurethane-acrylate mixtures or of nitrile latex and also standing out from the shoe sole in particular color-wise. In this way, a slippage prevention means is formed for the insole.

A further shoe insole is known from US 2002/0066209 A1, wherein here a plurality of striped patterns is disclosed which extend from one side or from one edge of the sole face to the other and may either be continuous or interrupted. The linear patterns may in this case consist both of straight and curved lines. The document alternatively discloses a non-slip coating provided in the manner of an entangled mesh.

Starting from these known coatings, it is the object of the present invention to provide an insole for shoes which provides a non-slip effect in the desired manner and at the same time exhibits sufficient flexural rigidity, while simultaneously largely retaining the desired characteristics inherent in the base material of the insole, such as for example air permeability and/or breathability.

Said object is achieved by an insole for shoes having the features of claim 1, wherein the coating is formed of a plurality of individual patterns formed by coating lines, said patterns being discrete from one another and arranged in such a way that they cannot be formed by one or more continuous coating lines extending continuously from a first side of the sole face to an opposing second side of the sole face.

Individual patterns should here be understood to mean patterns which take the form of open or closed patterns. Open patterns are in this case patterns in which the start of the line has no contact with the end of the line and closed patterns are those in which the start and end of a line can no longer be identified, since they are joined together. Furthermore, only those patterns which cannot be reduced to a single dot or a single straight line are individual patterns according to the invention. This means that an individual pattern must be more than one dot, wherein, where a pattern takes the form of a line, the line must not extend exclusively as a straight light in just one vector direction, but rather this line pattern must comprise at least one curve and/or at least one bend.

This ensures that the coating lines do not merely run in a preferential direction.

Mutually discrete individual patterns are those which are either completely separate from one another or indeed those which may form a tangent to, intersect and/or overlap one another. Despite forming a tangent, intersecting or overlapping, this individual pattern is in this case nevertheless identifiable as an individual pattern from its extensive extent defined by the direction predetermined by the coating line. Individual patterns are also understood to means groups of patterns which are composed in particular of at least two identical and/or different pattern elements. Such pattern groups are in particular understood to mean arrangements in which at least two pattern elements are arranged next to and in contact with one another, or in particular also arrangements in which one pattern element at least partly surrounds or encircles another pattern element, such as for example concentric arrangements, in particular circles, ovals, triangles or other polygons or nested geometric figures of any type which touch at one point.

It goes without saying that the individual patterns formed from coating lines are at least partly, preferably completely surrounded by an uncoated region and/or also comprise an uncoated region and at least partly, preferably completely encircle this uncoated region.

It goes without saying that the coating of the sole face of the insole consists exclusively of coating lines and that the sole face is not coated all over by a continuous, full-cover, uninterrupted coating.

The individual patterns are achieved by coating lines, wherein a line is understood to mean an element with a line width of at least 0.2 mm and the line has a length which amounts to at least 5 times the line width.

The coating lines of an individual pattern here in principle comprise both straight lines and curved lines, and corresponding intersecting lines. The lines may in principle be both continuous and interrupted, provided a line remains clearly identifiable as such. In other words, dashed, dash-dotted or dotted coating lines are also conceivable for the purposes of the present invention. In particular, the interrupted points may not be longer than 10 times, in particular no longer than 8 times, in particular no longer than 6 times, in particular no longer than 4 times the line width of the line adjoining this interrupted point.

The sides of the sole face are understood to mean all the borders or edges thereof.

One particularly preferred embodiment may provide that at least one individual pattern is configured such that, for each direction extending in the sole face or, in the case of a curved sole, for each direction tangential to the sole, one portion of this individual pattern extends perpendicular thereto. This means that, provided the sole lies flat, for each possible direction in the sole face there is one portion or region in the individual pattern which extends perpendicular thereto. By configuring the linear coating with a curvature, a better distribution of forces in different directions may be achieved. In this way, particularly good slip prevention may be achieved. According to one further preferred embodiment, the portion may be dot-shaped, wherein a notional tangent applied to this dot always extends perpendicular to a direction in the shoe sole.

Particularly preferably, at least 20%, in particular at least 40%, in particular at least 50%, in particular at least 60%, in particular at least 80%, in particular 100% of the individual patterns comprise at least one portion which extends perpendicular to any desired direction of the sole face. In particular in the case of at least 20%, in particular at least 40%, in particular at least 50%, in particular at least 60%, in particular at least 80%, in particular 100% of the individual patterns, this at least one portion takes the form of a dot and a notional tangent applied thereto extends perpendicular to any desired direction in the sole face.

The individual patterns provided on the sole side may exhibit the same or different geometric shapes and in particular the same and/or different measurements/dimensions.

Furthermore, at least one individual pattern may preferably be formed as a pattern group, which comprises at least two pattern elements formed from coating lines. Particularly preferably, at least 20%, in particular at least 40%, in particular at least 50%, in particular at least 60%, in particular at least 80% of the individual patterns are formed from a pattern group. More particularly, each individual pattern is constructed from a plurality of pattern elements. The pattern group may for example be constructed from inner and outer pattern elements and/or pattern elements joined together to form an overall pattern or further pattern elements which are for example arranged next to one another and touching one another. Particularly preferably, provision may be made for one pattern element of an individual pattern to encircle a second pattern element at least in places, but in particular completely. Encircling should in this case also be understood to mean that the lines touch one another at least in places or run parallel to one another. Such patterns may in particular be arranged ergonomically.

In this case, provision may in particular be made for the individual patterns to be surrounded by an uncoated outer region which has a different geometric shape from the geometric shape of the individual patterns. In this way, it is in particular also intended to ensure that, unlike for example in the case of grid patterns and striped patterns, there are no preferential directions, but rather slip prevention can be provided equally well on all sides.

Particularly preferably, at least one individual pattern is enclosed on all sides by an uncoated outer region.

Particularly preferably, a plurality of individual patterns applied to the sole face per insole are surrounded on all sides by an uncoated outer region. All the individual patterns per insole are particularly preferably surrounded by an uncoated outer region. In this way, on the one hand it is ensured not only that the flexural rigidity of an insole may be increased by the linear rather than the hitherto known punctiform coatings, so ensuring easier insertion into the sole, but also that greater stability of the insole under load is achieved, for example in a sports shoe, where the insole has to absorb the load caused by the slippage of the foot in the shoe. On the other hand, it is at the same time ensured that, in contrast to an all-over coating application, the desired characteristics of the base material of the insole, such as for example air permeability and/or breathability of the insole may be retained.

Such soles with a linear coating in the form of individual patterns constitute a good compromise with regard to flexural rigidity, air permeability and/or breathability with simultaneously good ergonomic adaptation to the foot of a wearer or to the surface contours of the shoe.

Depending on the desired pattern and depending on the desired adjustment of the non-slip characteristics, provision may be made for the plurality of individual patterns to be applied in a regular repeat or arranged irregularly.

In this case, provision is made in particular for the plurality of individual patterns to cover the sole face substantially over the entire extent thereof, i.e. not only specific regions such as the heel and/or the ball of the foot. Provision is therefore preferably made for that the individual patterns to extend over the entire sole face, wherein, depending on the intended pattern, individual regions of the sole face, such as for example the ball region and/or heel region, may exhibit an increased pattern density and other regions, such as for example the arch of the foot, may have a lower pattern density. It is also conceivable, depending on the region of the sole face, to select different individual patterns or to vary the pattern size. It is furthermore also conceivable, for example in the region of the ball of the foot and/or the heel, to configure the patterns in such a way that they intersect and/or overlap and/or form tangents to one another, whereas in the remaining region the patterns have a smaller degree of overlap or fewer points of intersection or fewer points of contact with other patterns and at the extreme are even arranged separately from one another in the remaining regions.

Particularly preferably, the sole face may exhibit a degree of coverage by the coating lines of at least 6%, in particular at least 8%, in particular at least 10%, more particularly at least 20% and in particular of at most 50%, more particularly at most 40% and more particularly at most 30%. In this way, good flexural rigidity of the insole is nevertheless achieved and desired characteristics of the base material, such as for example air permeability and breathability are not too greatly changed, but rather are retained.

If the individual patterns are considered in total, they preferably occupy a proportion of the surface area of the sole face of at least 20%, in particular at least 30% and more particularly at least 40% and in particular at most 80%, more particularly at most 70% and more particularly at most 60%. The area of an individual pattern is here understood to be the region enclosed by the outer coating lines (including the coating lines); thus the inner, uncoated regions of the individual pattern or, in the embodiment as a pattern group, the associated areas of the individual pattern elements are also taken into account. The areas covered by the individual patterns may ensure sufficient non-slip characteristics while nevertheless also ensuring the desired adequate flexural rigidity and retaining the characteristics inherent to the base material, such as for example air permeability and breathability.

One individual pattern preferably comprises an area with a spacing between the external coating lines of at least 0.3 cm, preferably at least 0.5 cm, more preferably at least 0.7 cm, more preferably at least 1.0 cm, more preferably at least 1.5 cm, more preferably at least 2 cm, more preferably at most 5 cm, more preferably at most 4 cm, more preferably at most 3 cm. The spacing, which may for example be a diameter, is in this case the distance between the respective distally furthest apart coating lines which describe or delimit an individual pattern. The measurement is taken at the outer edge of the coating line, i.e. inclusive of the line width thereof.

An individual pattern preferably comprises, including the circumscribing coating lines, an area of at least 0.2 $cm^2$, more preferably of at least 0.5 $cm^2$, more preferably of at least 1.0 $cm^2$, more preferably of at least 1.5 $cm^2$, more preferably of at most 10.0 $cm^2$, more preferably of at most 8.0 $cm^2$, more preferably of at most 6.0 $cm^2$.

The individual patterns may be different or the same with regard to their geometric shape and/or their dimensions. The various characteristics of the insole, such as degree of coverage, non-slip characteristics, flexural rigidity, air permeability and breathability may here be taken into account and achieved by adjusting the individual patterns.

Particularly preferably, individual patterns have curved or rounded regions, since these allow better ergonomic adaptation.

The line width may amount to at least 0.2 mm, in particular at least 0.4 mm, in particular at least 0.5 mm and more particularly at least 0.6 mm. In this case, the line width should preferably amount to at most 2 mm, more particularly at most 1.6 mm, more particularly at most 1.2 mm, more particularly at most 1.0 mm. Line length should constitute at least 5 times, preferably at least 6 times, more preferably at least 8 times and more preferably at least 10 times line width.

The height of the coating lines should amount to at least 0.1 mm, in particular at least 0.2 mm. The height of the coating line should here be at most 0.8 mm, more particularly at most 0.6 mm and more particularly at most 0.4 mm. The measurement of the height may be determined using a microscope with an appropriate magnification, specifically as the difference between an average upper edge of the base material and the upper edge of the coating line.

Tactile effects which may be perceived as unpleasant by the foot are advantageously avoided with these preferred heights of the coating lines.

The basis weight of the coating may amount to at least 5 $g/m^2$, in particular at least 10 $g/m^2$, more particularly at least 15 $g/m^2$ and more particularly at least 20 $g/m^2$.

The upper limit of the basis weight should preferably be 50 $g/m^2$ and more particularly at most 30 $g/m^2$.

The coating is in particular polymer-based and in particular based on a polymer taken from the group comprising PE (polyethylene), PP (polypropylene), APAO (amorphous polyalphaolefins), EVA (ethylene/vinyl acetate), EVAC (ethylene/vinyl acetate copolymer), PA (polyamides), TPE-O (thermoplastic polyolefins), TPE-V (thermoplastic polyolefin elastomer vulcanisates), TPE-E (thermoplastic copolyesters), TPE-U (thermoplastic polyurethanes), TPE-A (thermoplastic copolyamides, for example PEBA), TPE-S (thermoplastic styrene block copolymers), such as for example HSBC (hydrogenated styrene block copolymers), SEBS (styrene-ethylene-butadiene-styrene polymers), SBS (styrene-butadiene-styrene), SEPS (styrene-ethylene-propylene-styrene) or a combination of one or more of the stated polymers.

Possible preferred materials for the coating are those with a Shore A hardness of at least 30, in particular of at least 40, in particular of at least 50, more particularly at least 60 and in particular of at most 90, more particularly of at most 80, more particularly at most 70. Shore A hardness constitutes a material characteristic of elastomers and plastics. Shore A hardness is determined using the following method.

Method for determining Shore-A hardness:

Shore A hardness is a measure of the resistance of a material against the penetration of a body of a given shape under a defined spring force. In Shore hardness units, the value 0 indicates the smallest and the value 100 the greatest hardness.

Measurement is performed on the basis of DIN standard 53505:2000-08 and ISO standard 868:2003(E). A Shore A hardness tester is used for this purpose. Such a Shore A hardness tester, which is depicted schematically in FIG. 5 with reference sign 60, uses a spring-loaded indenter with the geometry of a truncated cone. The steel indenter 62 has a diameter D1 of 1.25±0.15 mm, which leads into a lower truncated cone with a lower face with a diameter D2 of 0.79±0.01 mm and an angle of inclination W of 35°±0.25°. The distance C between the lower edge of a presser foot 64 and the lower face of the indenter amounts to 2.5±0.02 mm. The indenter is introduced centered into the presser foot 64 in an opening with a diameter D3 of 3±0.5 mm.

Testing should be performed on test specimens which have not previously been exposed to mechanical stress. For testing, test specimens should already have been completely polymerized or completely vulcanized for 16 hours. Testing is performed under standard conditions of 23±2° C. and 50±2% atmospheric humidity. The test specimens and the equipment are conditioned accordingly for at least 1 hour.

The test specimens require dimensions which allow measurements to be taken at least 12 mm from each edge, and must at the same time have a sufficiently plane-parallel bearing face, so that the presser foot can be in contact with the test specimen over an area with a radius of at least 6 mm around the tip of the indenter. Test specimens with a material thickness of at least 4 mm are necessary. In the case of lower thicknesses, the test specimens may be composed of a plurality of thinner layers. Each test specimen is measured at at least 5 different locations, wherein the distance from the edges of the test specimen amounts to at least 12 mm. The distance between the measurement locations should amount to at least 6 mm. The pressure weight of the indenter amounts to 1 kg.

The measurement time amounts to 3 seconds, i.e. the hardness is read off 3 seconds after contact between the bearing face of the tester and the test specimen.

The coating lines are here preferably applied by means of a roller, which is engraved with the pattern (all of the individual patterns).

The sole side with the coating may exhibit a dynamic coefficient of friction measured on the basis of ASTM D 1894-01 of at least 0.6, in particular at least 0.8 and more particularly at least 1.0, wherein maximum values of at most 2.0, more particularly at most 1.5 and more particularly at most 1.2 must be achieved. In this way, sufficient friction forces are produced, while on the other side easy removability of the insole is ensured.

Test for Determining Dynamic Coefficient of Sliding Friction:

In the present case, the slip behavior of coated insoles according to the invention is to be determined. In this respect, the sole face of the insole provided with the coating is drawn over a standardized surface. The sliding friction force A arising is measured and the dynamic coefficient of sliding friction is then determined therefrom. The test method is based on ASTM D 1894-01, for determining the frictional behavior of plastics films.

The test specimens must be conditioned for at least 2 hours in a standard atmosphere at 23° C.±2° C. and 50%±2% atmospheric humidity. The specimens must not be bent, creased or scratched; other changes and soiling must be avoided. The same applies to the steel test plate. The test method must likewise be performed under standard conditions (23° C.±2° C., 50%±2%).

A test specimen of dimensions 50×50 mm is stamped out of the coated insole or out of a corresponding roll of material and fastened without creases to a friction pad. The roll of material is, however, exactly the same material from which the insoles according to the invention are stamped.

The friction pad has a base area of 63 mm×63 mm edge length, i.e. a contact area of 40 $cm^2$ and a mass of 200 g±5 g. It is fastened via a filament (without intrinsic elongation) to the force sensor of a tensile testing machine to DIN 51 221, class 1. An example of such a tensile tester is the Zwick Roell, model 2010 from Zwick GmbH&Co.KG, 89079 Ulm, Germany.

The accessory unit consisting of sample table and friction pad to DIN EN ISO 8295:2014 is likewise supplied by Zwick. The friction pad with the test specimen is placed carefully onto a defined material, a smoothly polished steel plate (DIN EN 1939: 2003-12) and the test is started 15 seconds after this. The test velocity amounts to 150 mm/min, both for the actual measuring path of 130 mm and for the pre- and post-measuring paths of in each case 10 mm. Only the force curve of the 130 mm measurement path is used to determine the dynamic coefficient of sliding friction p. The test is performed on at least five test specimens. An average x and the standard deviations are stated rounded to two decimal places. The dynamic coefficient of sliding friction is obtained from the quotient of the sliding friction force A determined in this way expressed in grams (g) and the 200 g force exerted by the friction pad.

Furthermore, the insole must have a preferred flexural rigidity of at least 500 mN, in particular at least 600 mN, more particularly at least 700 mN, more particularly at most 3000 mN, more particularly at most 2000 mN.

The insole may have a greater flexural rigidity than an insole without coating lines on the sole face, wherein in particular the flexural rigidity is increased by 5%, more particularly by 10%, more particularly by 15%. However, the flexural rigidity should preferably be increased by at most 50%, more particularly by at most 40% and more particularly by at most 30% by the coating lines of the individual patterns. Flexural rigidity is here determined using the following test:

Test for Determining Flexural Rigidity

The recovery, i.e. inherent stability, of insoles according to the invention is determined by determining the flexural rigidity of in each case 10 patterns using a commercially available device for determining flexural rigidity (at 23° C.±2° C. and 50%±2% atmospheric humidity). The device used here for measurement was model 58963.013 obtained from Karl Frank GmbH, Weinheim-Birkenau, DE. Any similar device may also be used, wherein the basic settings of the device (bending length, force arm, bending angle, angular rotational velocity) and also of the defined test specimens must be taken into account. In each case, 10 insole patterns were measured. A bending angle of 30° and a bending length of 10 mm were used. The cantilever length for positioning of the measurement sensor amounts to 6 mm within the edge zone of the test specimen 37 (see FIGS. 4*b* and 4*d*). The device 30 used to measure flexural rigidity is shown schematically in FIGS. 4*a* to 4*d*. In addition, an angular velocity of 6°/sec. was established for the measurement. A test specimen of dimensions 40 mm×40 mm was defined as the test specimen. For products of larger dimensions, the correspondingly defined test specimen was stamped out.

The device 30 used to measure flexural rigidity here comprises a specimen holder 32 with a clamp 34 and a knurled screw 36, which enables the two clamping plates 34*a* and 34*b* to come together to fasten the test specimen 37 in place. In this case, the clamp 34 is applied to a disc-shaped plate 38, wherein this plate 38 performs a clockwise rotation according to the input bending angle (here 30°) as a result of functional control internal to the device while the measurement is being carried out. The angular velocity of the plate 38 amounts to 6°/sec. The selected bending angle may here be set on a further region 40 of the apparatus and adjusted by means of a knurled screw 42. The actual measuring apparatus 44 comprises a measurement cell 46, in which the forces absorbed by a measurement sensor 48 are converted into measured force value and ultimately displayed as a measured value on a display 50. In this device, the measurement sensor 48 takes the form of a vertical cutting edge. The above-mentioned bending length L (i.e. the length of the force arm) can here be set by adjusting the measuring apparatus 44 in the direction of the arrow 53 using a knurled screw 52. The bending length L should here be understood to mean the length of the region located between the measurement sensor and the closest edge of the clamp 34 and forming the force arm; the bending length L is 10 mm.

To perform the test, the quadrangular test specimen 37 (see FIG. 4*d*) is fixed in the sample holder 32 between the clamping plates 34*a, b* of the clamp 34. The clamp 34 and its clamping plates 34*a, b* here have a width of 2.4 cm and a length of 4.0 cm. The test specimen 37 is here clamped with the top comprising the coating facing the measurement sensor. In addition, before the start of the test the cutting edge of the measurement sensor is moved towards the other end region of the test specimen until it comes into contact with the specimen and is adjusted such that the test specimen just touches the cutting edge of the measurement sensor. The cantilever length 55 of the test specimen 37 beyond the cutting edge of the measurement sensor amounts to around 6 mm (see FIG. 4*d*). When carrying out the measurement, the plate 38 rotates with the clamp 34 clockwise up to the stated bending angle, so leading to deformation of the test specimen. The test specimen is bent against the measurement cell. The forces caused by the deformation are converted into readable measurement data and displayed on the display 50.

The insole may here be of single- or multilayer construction with regard to the base material and in particular comprise a nonwoven material. The nonwoven materials preferably comprise natural cellulose-based fibers or synthetic fibers or mixtures thereof.

The base material comprises, in particular also in the case of a multilayer base material, a base layer with a basis weight preferably of at least 180 g/m$^2$, more preferably of at least 200 g/m$^2$, more preferably of at least 220 g/m$^2$, more preferably of at most 300 g/m$^2$, more preferably of at most 280 g/m$^2$, more preferably of at most 250 g/m$^2$.

The thickness of the insole, including the coating on the sole face preferably amounts to 1-3 mm, preferably 1-2 mm.

The thickness of an insole (including the coating) is determined using a specific measuring pressure of 0.5 kPa on a sensor surface of 25 cm$^2$. A thickness meter DMT from Schroder may in particular be used. Furthermore, the thickness is determined on the basis of DIN EN ISO 9073-2: 1995.

The insole preferably has an air permeability of at least 50 mm/s, in particular at least 70 mm/s, more particularly at least 100 mm/s.

Air permeability is here determined as follows:

Measurement of air permeability is based on standard DIN EN ISO 9237: 1995-12. Air permeability is expressed as a velocity at which a stream of air passes through the test specimen perpendicular to the surface under specified conditions, namely for the test area, differential pressure and time.

The test device used is an air permeability tester to DIN EN ISO 9237. Such an air permeability tester comprises a circular specimen holder with an opening with a defined test area of 20 cm$^2$, also an apparatus for secure, torsion-free fastening of the test specimen, preferably additionally also a protective ring apparatus, as an accessory to the above-stated apparatus for preventing air from escaping over the specimen edges, also a pressure gauge connected to the test head, an apparatus for generating a constant air flow and for adjusting flow velocity, with which a differential pressure may be produced and additionally a flow meter for indicating flow velocity. Device model FX 3300 Labortester III from Textest AG, Schwerzenbach, Switzerland may be used to carry out the measurement.

To prepare the specimen, the specimen must be stored prior to the start of the test for at least 24 hours in a standard atmosphere at 20±2° C. and 65±4% relative humidity. The same conditions must be established during testing (20±2° C. and 65±4% RH).

The test specimen must be fastened to the circular specimen holder with sufficient tension to avoid creases. If creases do, however, occur, care must be taken to ensure that the sheet material, i.e. the test specimen, is not twisted in the clamping plane. In the case of the insole to be measured, the sole face is clamped with the coating facing the low pressure side, to avoid leaks. The exhaust fan, which is suitable for forcing the air through the test specimen or another such apparatus must be started up and the flow velocity adjusted continuously until the differential pressure is reached. Once flow velocities have been reached under stable conditions, flow velocity should be noted after waiting at least one minute. The test must be repeated at least 10 times under the same conditions at different points of the test specimen. In the present case, the insole is exposed to a differential pressure of 100 Pa.

Air permeability R should be calculated in mm/s using the equation stated in the standard:

$$R = \frac{q(v)}{A} \times 167$$

The following definitions apply q (v): arithmetic mean of the air flow in $dm^3$/min (l/min)

A: test area, in $cm^2$, here 20 $cm^2$

167: conversion factor from $dm^3$/min or l/min per $cm^2$ to mm/s

In the case of investigations, in which no test specimen is available or can be provided which is adapted to the test area of the circular specimen holder, such as for example in the case of relatively small and/or non-circular test specimens, a test specimen may be used which has been assembled with a support material. When the measurement is performed, parallel measurements necessary for correction and normalization, i.e. "negative" and "zero checks", which take account of the support and adhesive materials, must be performed in addition to measurement of the actual test specimen and included in the evaluation.

The insole is preferably a disposable product. Insoles which may be washed or cleaned are, however, also conceivable in principle.

In the present manner, it is possible to provide an insole which has particularly favorable characteristics with regard to flexural rigidity, breathability, air permeability and non-slip characteristics.

Figure 2:
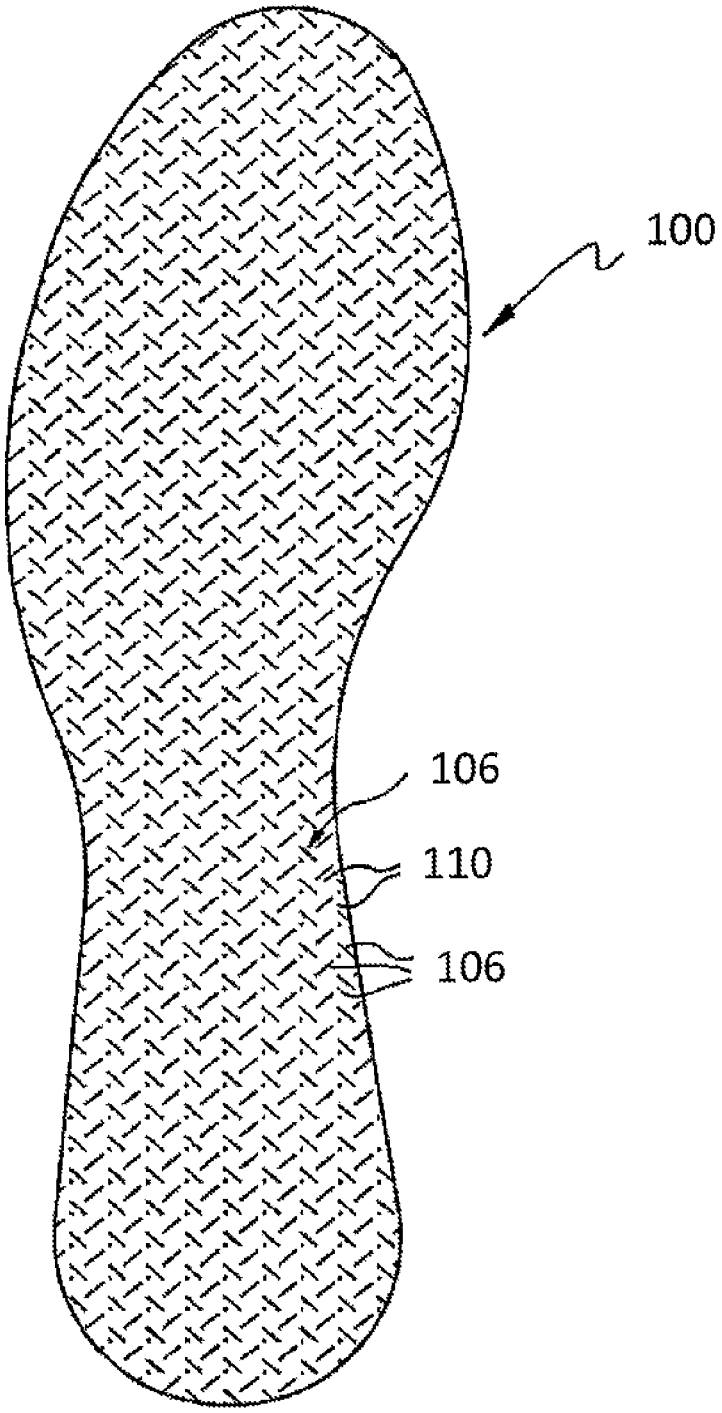
Figure 3A:
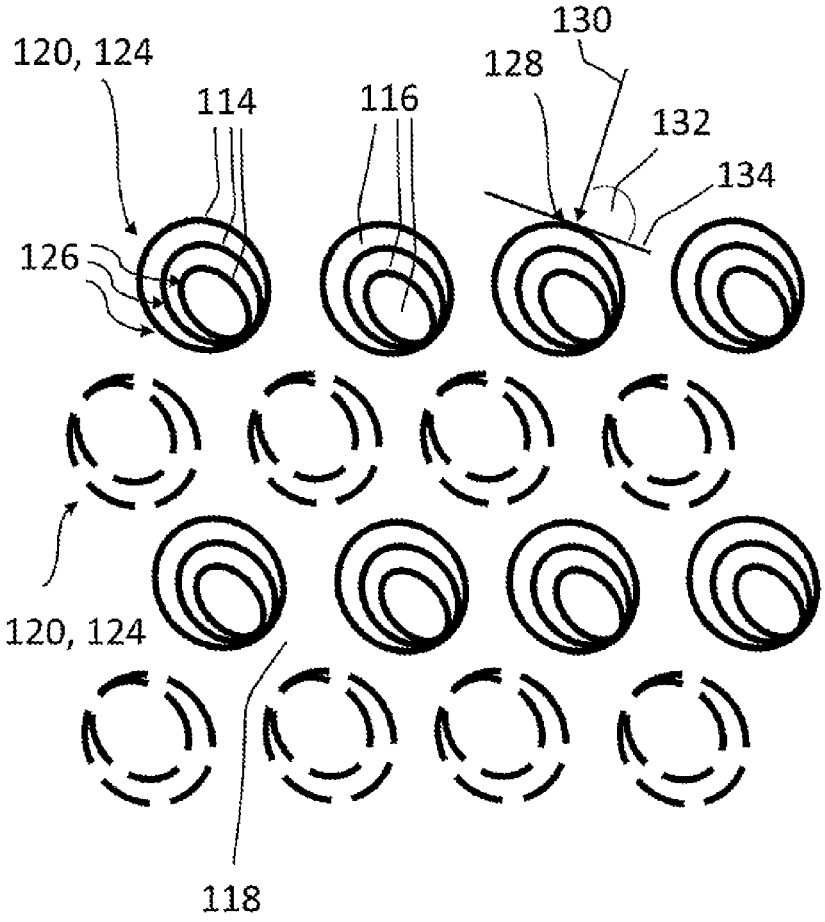
Figure 3B:
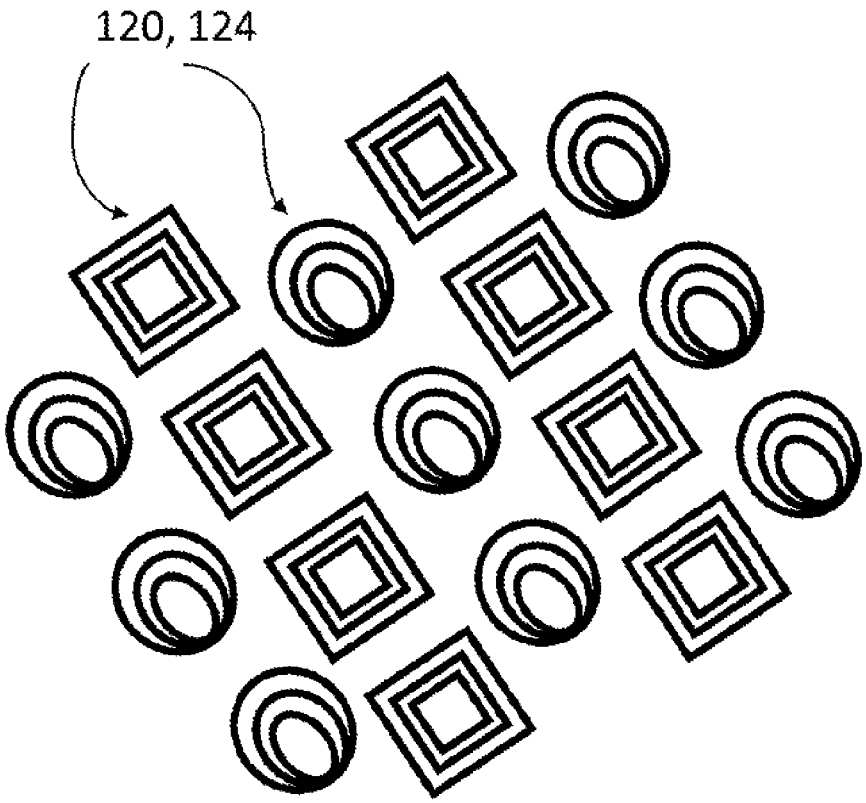
Figure 3C:
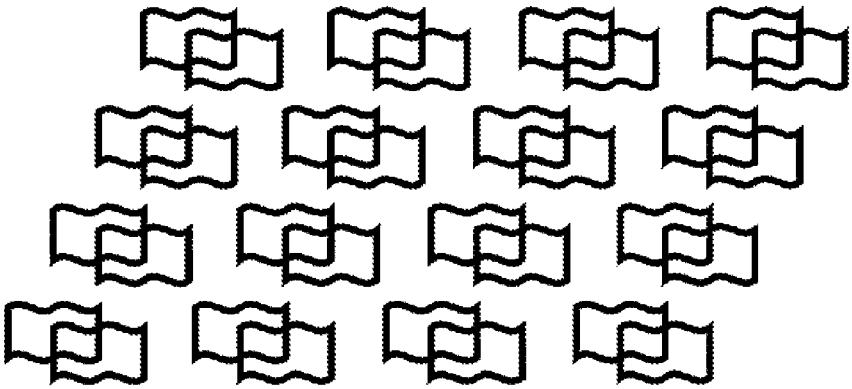
Figure 3D:
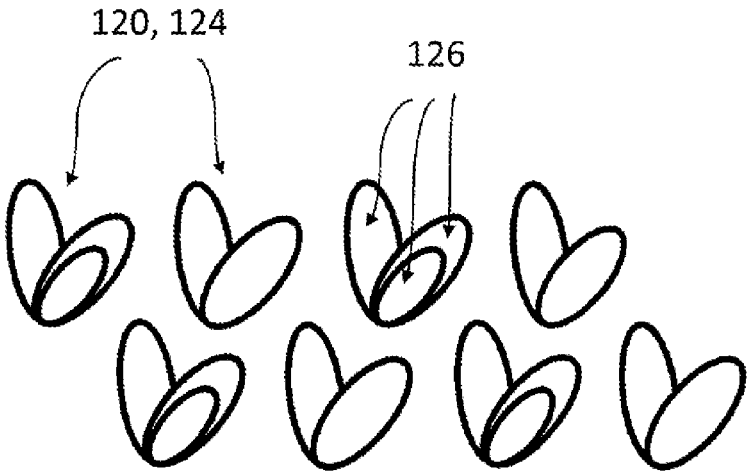
Figure 3E:
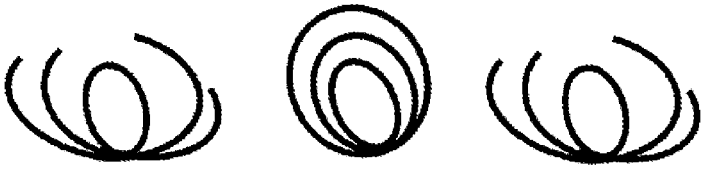
Figure 4A:
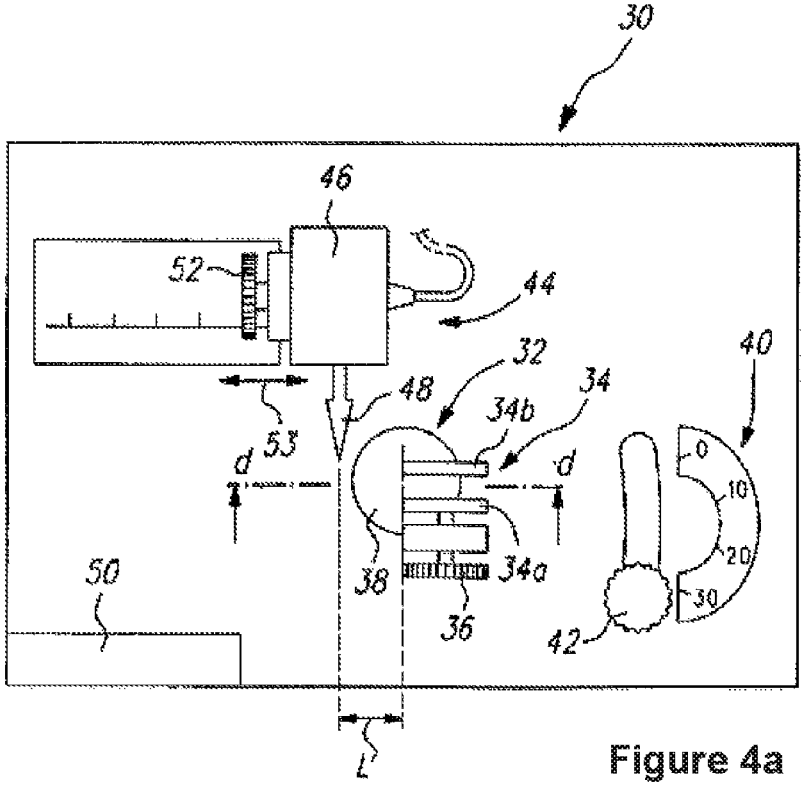
Figure 4B:
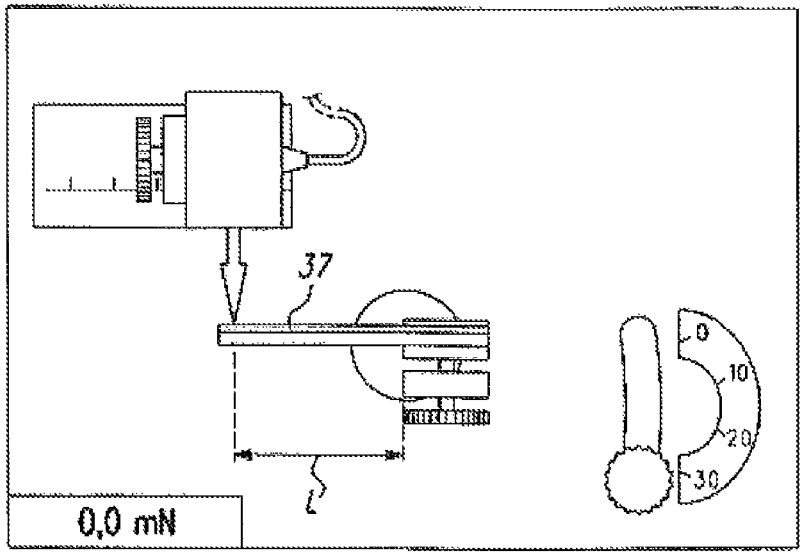
Figure 4C:
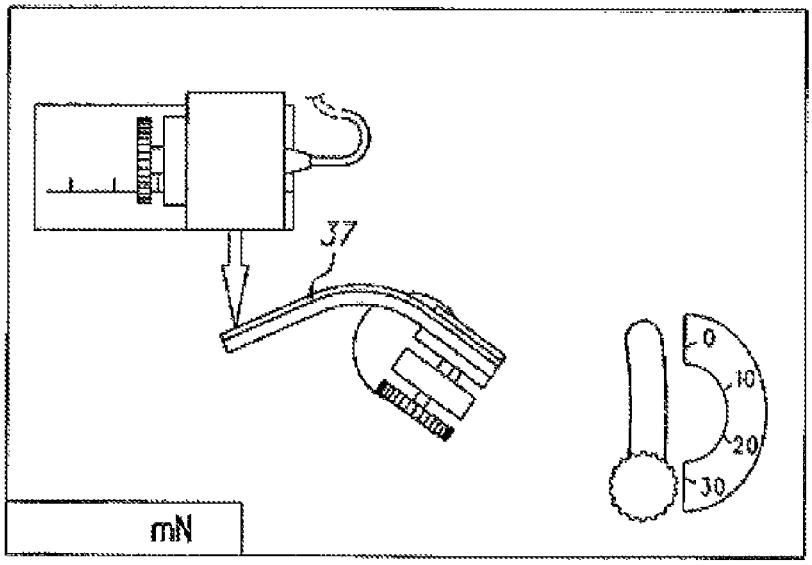
Figure 4D:
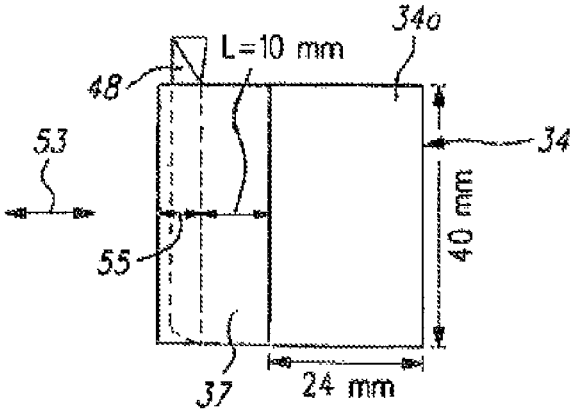
Figure 5:
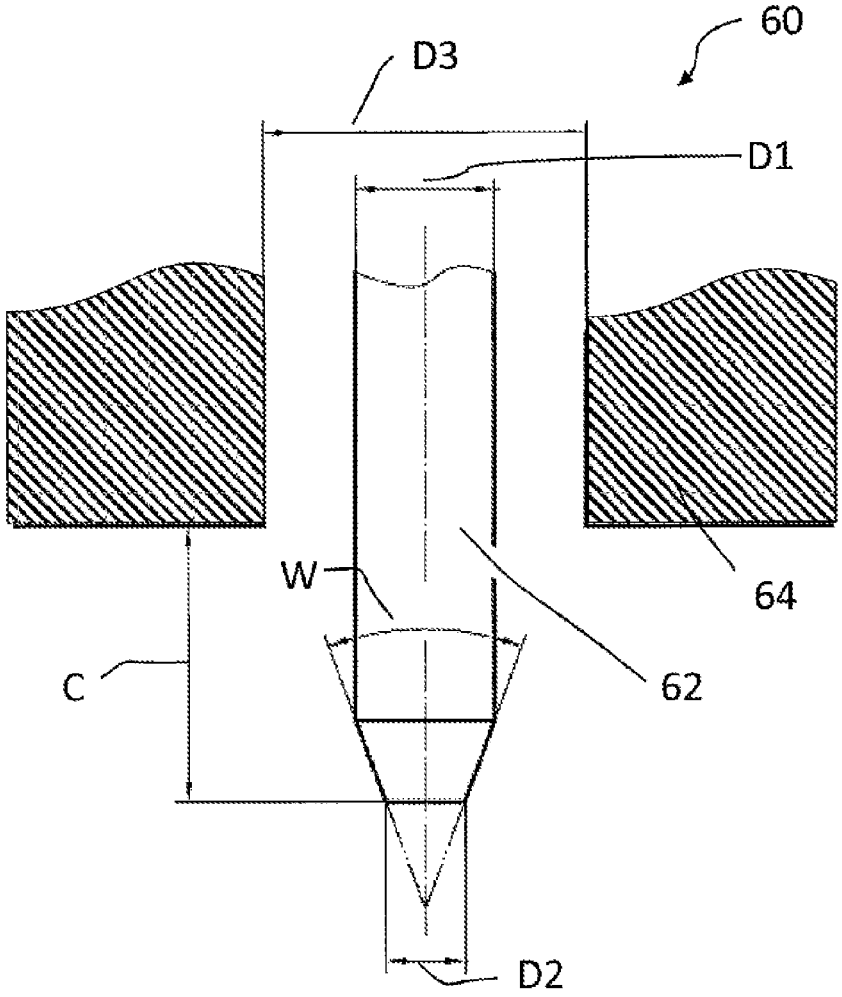

Further features and details and advantages of the invention are revealed by the drawings and the following description of the shoe sole according to the invention. In the drawings:

FIG. 1 is a representation of a sole face of an insole according to the invention FIG. 2 shows an insole prior to application of the coating, FIGS. 3*a-e*) show various individual coating patterns, FIGS. 4*a-c*) show a schematic plan view, not true to scale, of a flexural rigidity gauge with performance of the measurement, FIG. 4*d* shows a view of the sample holder in the direction of the arrows D-D in FIG. 4*a* and FIG. 5 shows a schematic representation, not true to scale, of a portion of a Shore A hardness tester.

FIG. 1 shows a plan view onto the sole face of an insole 100 according to the invention, wherein, when the insole is applied, the sole face 102 faces an inner sole of a shoe and the opposite face from the sole face is the foot face, facing the foot. The insole 100 consists of a base material of nonwoven materials made from a mixture of natural cellulose-based fibers and synthetic fibers. This base material forms a nonwoven wadding layer and is bonded by calendering with an embossing calender, i.e. it was passed between a heated calender roll with protruding embossing projections and a counter-pressure roll. In this way, the surface texture apparent from FIG. 2 is formed in the case illustrated with dot-shaped and rib-like embossed structures 106. The engraved depth achieved by calendering amounts in the present case to 0.7 mm, but may be adjusted as desired by the person skilled in the art on the basis of his or her specialist knowledge. In the region of the embossing, highly compressed embossed regions 106 are formed next to comparatively less compressed regions 110. The proportion of highly compressed regions 106 compared to the total area amounts in this case to 5-10%.

In the case of a multilayer base material, the layers may be joined together by pressure and temperature using a calender system with two steel rolls, the embossing 106 being applied simultaneously. That is to say, one of the two calender rolls comprises engraving.

The multilayer base material of the insole here comprises a base layer with a grammage of preferably 200-250 g/$m^2$.

As FIG. 1 shows, a coating 112 of coating lines 114 is provided on the sole face 102 of the insole 100 remote from the sole of the foot and facing the inner sole of a shoe. This serves to prevent the insole 100 from slipping in the shoe and furthermore to improve the flexural rigidity of the sole. The coating lines 114 are polymer-based and preferably consist of EVA (ethylene-vinyl acetate). The material preferably has a Shore A hardness of 60-80. The coating lines are applied by means of a gravure method, wherein the insole 100 is passed through between a gravure roll and a counter roll. The width of the coating lines amounts in the present case to 0.5-0.7 mm. The height of the coating lines preferably amounts to 0.2-0.3 mm, such that no uncomfortable tactile effects arise on the foot from the applied coating pattern.

The coating shown in FIG. 1 comprises a plurality of individual patterns 120, which are formed by coating lines 114. In the case illustrated, each individual pattern 120 is preferably formed by groups 124 of patterns, wherein the groups of patterns consist of at least three pattern elements 126, here of concentrically arranged circles and no coating compound is applied between the individual circles of each individual pattern group forming an individual pattern, i.e. an uncoated region 116 is present therein. In this way, a total degree of coverage on the sole face of around 20-25% is achieved by the coating lines 114. In total, a relatively high surface coverage of 80% of the sole face 102 is achieved by the individual elements 120 as such, i.e. the free areas outside the individual patterns 120, i.e. the outer, uncoated regions 118 surrounding the individual patterns, occupy around 20% of the sole face 102. In this way, the flexural rigidity of the insole 100 may advantageously be achieved while simultaneously only slightly impairing the desired characteristics attributed to the base material of the insole, such as for example air permeability and/or breathability, which is not significantly influenced by the coating.

Furthermore, a coating in which the individual patterns 120 may intersect, overlap or form a tangent but each individual pattern remains individually identifiable, and in particular the individual patterns cannot be joined by a continuous line which extends from one side (edge) of the sole 122*a* to the opposite side (edge) of the sole 122*b*, offers the advantage of there being no preferential directions. In each case, two opposing edge portions of the sole 100 are considered to be the sides (edges) of the sole 100. In this way, non-slip characteristics may be improved in all directions.

A particularly preferred coating is one in which, due to the configuration of the individual patterns 120, at least one individual pattern 120, preferably at least 20% of the individual patterns 120 on the sole face, particularly preferably each individual pattern 120, comprises a portion or region 128 which extends perpendicular, i.e. at an angle 132 of 90° to any desired direction 130 in the area of the insole 100, as illustrated schematically in FIG. 3*a*. In this way, each direction of movement has a proportion opposed to it which extends perpendicular to it, so achieving optimum slip prevention for this direction of movement. Such a portion may also be formed in that a notional tangent 134 may be applied which is perpendicular to the respective slip direction.

The optimum expression of the stated advantages is achieved in that the individual patterns 120 are discrete from one another and in particular do not merge with one another in such a way that the individual patterns 120 disappear into the overall pattern, as is the case for example for the individual rhombuses or squares in a grid pattern.

Further preferred individual patterns are shown in FIGS. 3*a*-3*e*, wherein both different individual patterns may be combined together, as shown in FIGS. 3*a*, 3*b*, 3*d* and 3*e*, and moreover the individual patterns may also, with regard to the configuration of the coating lines, exhibit differences with regard to both the height thereof and the width thereof. Furthermore, it is also feasible to make the coating lines not to be continuous but rather interrupted, as shown for example in FIG. 3*a*, insofar as this does not cause the overall patterns to break up in such a way that the patterns can no longer be recognized as such.

Insofar as an individual pattern 120 is composed as a pattern group 124 of multiple pattern elements 126, these may, as shown in FIGS. 3*a* and 3*b*, completely encircle one another with spacing but also encircle one another in such a way as to form points of contact. Furthermore, it is also possible for the individual pattern elements of an individual pattern 120 to be arranged to form touching or intersecting regions, as shown for example in FIG. 3*c*. The individual patterns according to FIGS. 3*a* to 3*e* may also, in a manner similar to FIG. 1, be configured such that the individual patterns intersect or overlap or form tangents to one another.

The dynamic coefficient of friction of the coated sole face amounts, measured on the basis of ASTM D 1894-01, to between 0.8 and 1.4. The flexural rigidity of the coated insole 100 according to the invention preferably amounts to 700-1000 mN, wherein a percentage increase in flexural rigidity is obtained over an uncoated sole of 15-20%. The air permeability of the insole amounts to around 100 mm/s.

The invention claimed is:

1. An insole (100) for shoes with a base material comprising a sole face (102) facing the shoe and an opposing foot face facing the foot, a coating (112) being provided on the sole face (102) which provides the sole face (102) of the insole (100) with an increased frictional force relative to the uncoated sole face (102), characterized in that the coating (112) consists of a plurality of individual patterns (120) formed by coating lines (114), said patterns being discrete from one another and arranged in such a way that they cannot be formed by one or more continuous coating lines (114) extending continuously from a first side (122*a*) of the sole face (102) to an opposing second side (122*b*) of the sole face (102).

2. The insole (100) of claim 1, further comprising wherein for any possible direction in the plane of the sole face (102) there is a corresponding portion of at least one individual pattern (120) that is perpendicular to this direction.

3. The insole (100) of claim 1, further comprising wherein at least one individual pattern (120) is formed as a pattern group (124), which comprises at least two pattern elements (126) formed from coating lines.

4. The insole (100) of claim 3, further comprising wherein a first pattern element (126) encircles a second or further pattern elements (126) at least in places.

5. The insole (100) of claim 1 further comprising wherein an uncoated outer region (118) surrounding the separate individual patterns (120) has a geometric shape which differs from a geometric shape of the individual pattern (120).

6. The insole (100) of claim 1 further comprising wherein at least one individual pattern (120) on the sole face (102) is enclosed on all sides by an uncoated outer region.

7. The insole (100) of claim 1 further comprising wherein the plurality of individual patterns (120) cover the sole face (102) substantially over the entire extent thereof.

8. The insole (100) of claim 1 further comprising wherein the sole face (102) exhibits a degree of coverage by the coating lines (114) of at least 6% and at most 50%.

9. The insole (100) of claim 1 further comprising wherein the individual patterns (120) in total occupy a proportion of the surface area of the sole face (102) of at least 20 at most 80%.

10. The insole (100) of claim 1 further comprising wherein the coating lines (114) have a line width of at least 0.2 mm, and at most 2.0 mm.

11. The insole (100) of claim 1 further comprising wherein the coating lines (114) have a length which corresponds to at least 5 times the width of the respective coating line.

12. The insole (100) of claim 1 further comprising wherein the coating lines (114) have a height of at least 0.1 mm, and at most 0.8 mm.

13. The insole (100) of claim 1 further comprising wherein the coating lines are formed by continuous lines and/or lines interrupted at least in places, wherein the interruption is no longer than 10 times, the line width of the line adjacent this interrupted point.

14. The insole (100) of claim 1 wherein the coating has a basis weight of at least 5 g/m$^2$, and at most 50 g/m$^2$.

15. The insole (100) of claim 1 wherein the coating is polymer-based and is formed from materials with a Shore A hardness of at least 30 and at most 90.

16. The insole (100) of claim 1 wherein the sole side with the coating has a dynamic coefficient of friction based on ASTM D1894-01 of at least 0.6, and at most 2.0.

17. The insole (100) of claim 1 wherein the insole has a flexural rigidity of at least 500 mN, and at most 3000 mN.

18. The insole (100) of claim 1 wherein the insole (100) has a flexural rigidity of from 15% to 20% greater than an insole without coating lines on the sole face (102).

19. The insole (100) of claim 1 wherein the base material of the insole (100) is of single-layer construction.

20. The insole of claim 1, wherein the base material of the insole (100) is of multilayer construction.

21. The insole of claim 1 which is of a non-woven material.

22. The insole of claim 21, wherein the coating has a Shore A hardness of from 30 to 90.

* * * * *